US007792439B2

(12) United States Patent
Kikuchi

(10) Patent No.: US 7,792,439 B2
(45) Date of Patent: Sep. 7, 2010

(54) IMAGE FORMING APPARATUS AND ASSOCIATED METHOD OF TRACKING RECYCLING INFORMATION

(75) Inventor: Hideo Kikuchi, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 497 days.

(21) Appl. No.: 11/227,488

(22) Filed: Sep. 16, 2005

(65) Prior Publication Data

US 2006/0062583 A1 Mar. 23, 2006

(30) Foreign Application Priority Data

Sep. 17, 2004 (JP) ..... 2004-272171

(51) Int. Cl.
*G03G 15/00* (2006.01)

(52) U.S. Cl. ..... 399/24; 399/43

(58) Field of Classification Search ..... 399/24, 399/27, 25, 26, 43
See application file for complete search history.

(56) References Cited

U.S. PATENT DOCUMENTS

| | | | | |
|---|---|---|---|---|
| 5,276,461 | A * | 1/1994 | Saito | 347/129 |
| 6,144,812 | A * | 11/2000 | Ueno | 399/12 |
| 6,173,129 | B1 * | 1/2001 | Kimizuka | 399/25 |
| 6,226,025 | B1 * | 5/2001 | Kim | 347/228 |
| 6,807,380 | B2 * | 10/2004 | Iida et al. | 399/12 |
| 7,296,873 | B2 * | 11/2007 | Harada et al. | 347/23 |
| 2002/0018657 | A1 * | 2/2002 | Serizawa | 399/27 |
| 2002/0154915 | A1 * | 10/2002 | Bullock et al. | 399/12 |
| 2003/0180059 | A1 * | 9/2003 | Iida et al. | 399/12 |
| 2004/0208660 | A1 * | 10/2004 | Ito et al. | 399/27 |
| 2004/0223011 | A1 * | 11/2004 | Adkins et al. | 347/7 |
| 2005/0036796 | A1 * | 2/2005 | Burchette et al. | 399/27 |
| 2005/0078969 | A1 * | 4/2005 | Kikuchi | 399/12 |
| 2006/0034627 | A1 * | 2/2006 | Kikuchi et al. | 399/24 |

FOREIGN PATENT DOCUMENTS

| | | | |
|---|---|---|---|
| CN | 1119716 | C | 8/2003 |
| JP | 04051259 | A * | 2/1992 |
| JP | 6-35264 | | 2/1994 |
| JP | 07064451 | A * | 3/1995 |
| JP | 2000-347550 | | 12/2000 |
| JP | 2001-22230 | | 1/2001 |
| JP | 2001125461 | A * | 5/2001 |
| JP | 2001-242752 | | 9/2001 |
| JP | 2002-182532 | | 6/2002 |
| JP | 2003091218 | A * | 3/2003 |
| JP | 2003167486 | A * | 6/2003 |
| JP | 2005195634 | A * | 7/2005 |
| JP | 2005202188 | A * | 7/2005 |
| JP | 2005234316 | A * | 9/2005 |

OTHER PUBLICATIONS

U.S. Appl. No. 11/203,973, filed Aug. 16, 2005, Kikuchi et al.
U.S. Appl. No. 11/227,488, filed Sep. 16, 2005, Kikuchi.

* cited by examiner

*Primary Examiner*—Quana M Grainger
(74) *Attorney, Agent, or Firm*—Oblon, Spivak, McClelland, Maier & Neustadt, L.L.P.

(57) ABSTRACT

An image formation unit detached to an image forming apparatus integrally mounts at least one replacement member, and a nonvolatile memory. The nonvolatile memory stores recycle information related to the replacement member to be used when the image formation unit is recycled.

16 Claims, 15 Drawing Sheets

| FIG. 13A |
| --- |
| FIG. 13B |

IMAGE FORMING APPARATUS AND ASSOCIATED METHOD OF TRACKING RECYCLING INFORMATION

CROSS REFERENCE TO RELATED APPLICATION

This application claims priority under 35 USC §119 to Japanese Patent Application No. 2004-272171 filed on Sep. 17, 2004, entire contents of which are herein incorporated by reference.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates to an image formation unit integrally mounting a plurality of replaceable members and detachable from an image forming apparatus, an image forming apparatus that employs the image formation unit, and a method of recycling the image formation unit.

2. Discussion of the Background Art

In an image forming apparatus, a process cartridge integrally mounting one or more replaceable members, such as a photoconductive drum, a developing device, a charging device, a cleaning device, etc., is sometimes employed to readily perform their maintenance. The process cartridge is monitored to replace with a new process cartridge at an appropriate time, because an image deteriorates as the process cartridge approaches a usage limit. For example, the process cartridge is replaced when end of the life is supposed based upon an accumulated number of image formations stored in a memory of the image forming apparatus. However, an accumulated number of image formations cannot be known in such a method when a process cartridge is replaced with a new process cartridge. Thus, the accumulated number of images is necessarily written on a memo when the process cartridge is replaced.

Then, an image forming apparatus is proposed such that an accumulated number of image formations is stored in a nonvolatile memory arranged in a process cartridge, while a usage limiting number of image formations is stored in a memory of an image forming apparatus, as discussed in Japanese Patent Application Laid Open No. 2002-182532. Such an image forming apparatus recognizes the end of life of the process cartridge and stops image formation when the accumulated number of images exceeds the usage limiting number of image formations. According to such an image forming apparatus, making memo is needless, because the accumulated number of image formations is stored in the nonvolatile memory. However, a replaceable member to be replaced is unknown when a process cartridge includes a plurality of replacement members.

Further, an image forming apparatus is proposed such that a life of a process cartridge is converted into a number of rotations of a photoconductive drum and the number is stored in a nonvolatile memory provided in the process cartridge. A number of practical rotations of the photoconductive drum is retained. A control section arranged in the image forming apparatus compares both numbers and recognizes a life thereof. Further, another method is proposed such that a replacement member is replaced when a number of recycling times of a photoconductive drum reaches a prescribed level, as discussed in Japanese Patent Application Laid Open No. 2000-347550. Thus, are placeable member to replace can be known.

However, information of a replaceable member newly installed in the process cartridge during recycling is not stored. Thus, a life of the newly installed replaceable member cannot be recognized. As a result, quality and credibility of a recycled process cartridge cannot be guaranteed.

SUMMARY OF THE INVENTION

Accordingly, an object of the present invention is to address and resolve such and other problems and provide a new and novel image forming apparatus detachably including an image formation unit. The new and noble image forming apparatus includes an image formation unit which mounts a replacement member with a nonvolatile memory that stores recycle information related to the replacement member. The recycled information is referred to when the image formation unit is recycled. A life detecting device is provided to detect life of one of the image formation unit and the replacement member. A usage inhibition code writing device is provided to write a usage inhibition code in the nonvolatile memory when the life detecting device detects end of the life of one of the image formation unit and the replacement member. The usage inhibition code notifies inhibition of reuse of the image formation unit and the replacement member.

In another embodiment, a replacement member code writing device is provided to write a code assigned to the replacement member in the nonvolatile memory when the life detecting device detects end of the life of the replacement member.

In yet another embodiment, a unit used time calculation device is provided to calculate a used time period in which the image formation unit is used. The nonvolatile memory stores a usage guaranteed time for the image formation unit. The life detecting device detects end of the life of the image formation unit by comparing the used time period with the usage guaranteed time.

In yet another embodiment, a replacement member used time calculation device is provided to calculate a replacement member used time period in which the replacement member is used. The nonvolatile memory stores a usage guaranteed time for the replacement member. The life detecting device detects end of the life of the replacement member by comparing the replacement member used time period with the usage guaranteed time.

In yet another embodiment, the nonvolatile memory stores a usable date of the image formation unit. The life detecting device detects end of the life of the image formation unit by comparing current time information with the usable date.

In yet another embodiment, the nonvolatile memory stores a usable date of the replacement member. The life detecting device detects end of the life of the replacement member by comparing current time information with the usable date.

In yet another embodiment, the current time information is transmitted from a control section of the image forming apparatus.

In yet another embodiment, the nonvolatile memory stores a limiting number of image formations for the image formation unit. The life detecting device detects end of the life of the image formation unit by comparing a total number of image formations executed by the image formation unit with the usage limiting number.

In yet another embodiment, the nonvolatile memory stores a limiting number of image formations for the replacement member, and the life detecting device detects end of the life of the replacement member by comparing of a total number of images formed by the image formation unit with the limiting number of image formations.

In yet another embodiment, the replacement member includes a rotation member. The nonvolatile memory stores a limiting number of rotations for the replacement member. The life detecting device detects end of the life of the rotation member by comparing a total number of rotations of the at least one rotation member with the limiting number of rotations.

In yet another embodiment, the rotation member includes a photoconductive drum, a developing roller, a charging roller, a transfer roller, and a fixing roller.

In yet another embodiment, the image formation unit includes one of a process cartridge, a developing cartridge, and a toner cartridge.

In yet another embodiment, the process cartridge integrally mounts at least one of an image bearer, a charging device, a developing device, a transferring device, and a cleaning device.

In yet another embodiment, the replacement member includes at least one of the image bearer and the cleaning device.

In yet another embodiment, the life detecting device detects end of the life of the toner cartridge when toner end is detected. The nonvolatile memory stores data indicative of no toner when the toner end is detected.

In yet an other embodiment, the nonvolatile memory includes an EEPROM.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
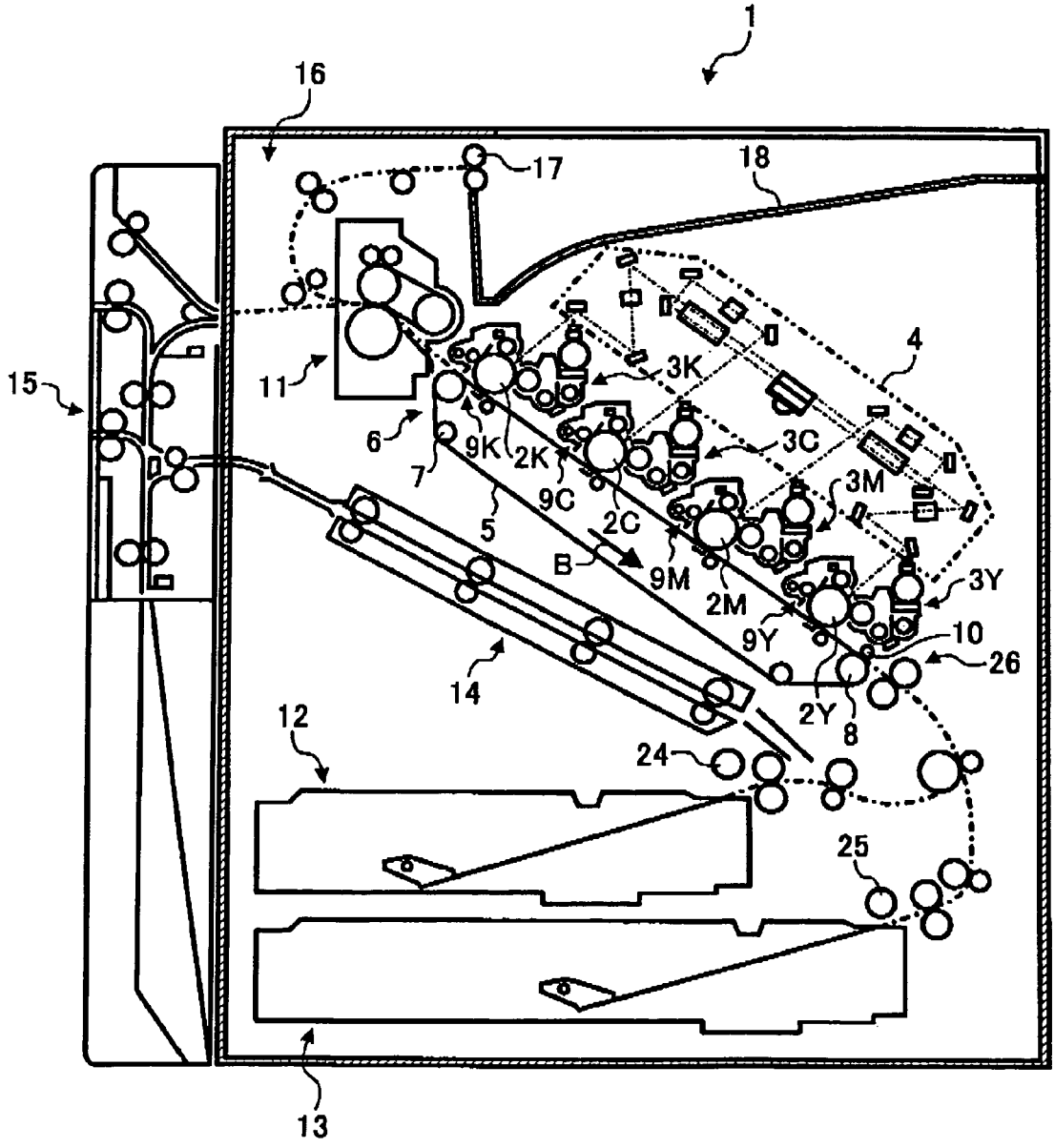
FIG. 1 illustrates an exemplary printer according to one embodiment of the present invention.

Referring now to the drawing, wherein like reference numerals designate identical or corresponding parts throughout several views, in particular in FIG. 1, an exemplary printer is roughly illustrated. As shown, a plurality of photoconductive member units 3Y, 3M, 3C, and 3K having photoconductive members 2Y, 2M, 2C, and 2K is arranged, respectively, in an image forming apparatus 1 in a box shape to form respective toner images of yellow, magenta, cyan, and black colors. Hereinafter, respective suffixes Y, M, C, and K represent yellow use, magenta use, cyan use, and black use members.

A writing unit 4 is arranged above the photoconductive member unit 3 to emit a laser light L from a laser diode as a light source to the respective photoconductive members 2Y, 2M, 2C, and 2K. The writing unit 4 scans the photoconductive members 2Y, 2M, 2C, 2K in turn by guiding the laser light L with a polygon mirror or the like. Below the respective photoconductive member units 3, a transfer unit 6 including a transfer belt 5 is arranged to receive transfer of toner images formed by the respective photoconductive member units 3. The transfer belt 5 is suspended by a driving roller 7, a driven roller 8, and a plurality of tension rollers while externally contacting the respective photoconductive members 2Y, 2M, 2C, 2K at its outer running surface. Inside the outer running surface of the transfer belt 5, transfer brushes 9Y, 9M, 9C, and 9K are arranged opposing the photoconductive members 2Y, 2M, 2C, and 2K as transfer devices. A transfer bias having a polarity opposite to charge of toner is applied to each of the respective transfer brushes 9Y, 9M, 9C, and 9K. A paper attracting roller 10 is arranged above the driven roller 8 via the transfer belt 5. A fixing unit 11 is arranged at the upper left of the transfer unit 6 so as to fix a toner image, transferred onto the transfer belt 5, onto a transfer sheet P. Since the transfer unit 6 is extended aslant in a diagonal direction of the image forming apparatus 1, a space occupied by the transfer unit 6 can be minimized in the horizontal direction.

Below the photoconductive member units 3Y, 3M, 3C, and 3K, a plurality of sheet feeding units 12 and 13 capable of accommodating different size transfer sheets P are arranged. Further, a duplex unit 14 and an inversion unit 15 are arranged to serve as a conveyance path used when images are formed on both sides of the transfer sheet P. An inversion conveyance path 16 is formed branching off from a path between the fixing unit 11 and the inversion unit 15. The inversion conveyance path 16 guides the transfer sheet P to an ejection tray 18 arranged on the upper portion of the image forming apparatus using an ejection roller 17 arranged on the conveyance path.

The above-mentioned photoconductive member units 3Y, 3M, 3C, and 3K have the same configuration to each other and are different in position in relation to the image forming apparatus 1, and form respective toner images of Y, M, C, and K on the photoconductive members 2Y, 2M, 2C, and 2K.

Now, a configuration of the photoconductive member unit 3M is typically described herein after. An exemplary interior configuration of the photoconductive member unit 3M is initially described with reference to FIG. 2. As shown, the photoconductive member unit 3M includes a charging roller 21M that applies charge, a developing device 22M that develops an image, and a cleaning device 23M around a photoconductive member 2M of a drum shape rotating in a direction shown by arrow A in the drawing. The charging roller 21M rotates in a direction opposite to that of the photoconductive member 2M, and is capable of uniformly supplying electric charge to the surface of the photoconductive member 2M. A charge cleaning roller 21*a* is arranged above the charging roller 21M to always contact and to clean the charging roller 21M. Further, a cleaning device 23M includes a cleaning blade 23*a* and a cleaning brush 23*b*. The cleaning blade 23*a* contacts countering and cleans the surface of the photoconductive member 2M, while a cleaning brush 23*b* rotationally contacts and cleans the surface of the photoconductive member 2M in an opposite direction to that of the photoconductive member 2M.

The above-mentioned developing device 22M uses two component developer including magnetic carrier and toner. A developing roller 22*a* is partially exposed from an opening of a developing case 22*b* on the photoconductive member side. Further arranged in the developing device 22 M are a plurality of conveyance screws 22*c* and 22*d*, a developing doctor 22*e*, a toner density sensor 22*f*, and a toner cartridge 30 or the like. The toner density sensor 22*f* is formed from a magnetic permeability sensor (i.e., a T sensor) so as to detect a magnetic permeability of developer. In the developing device 22M with the above-mentioned configuration, toner transmitted from the toner cartridge 30 by an air pump (not shown) and stored in the developing case 22*b* is stirred together with developer by the conveyance screws 22*c* and 22*d*. These toner and magnetic carrier are charged by friction therebetween to have opposite polarities to each other and are conveyed to the developing sleeve 22*a*. The thickness of the developer carried on the surface of the developing sleeve 22*a* is made constant by the developing doctor 22*e*, and is conveyed to a developing position opposing the photoconductive member 2M. Toner in the developer lying on the developing roller 22*a* moves toward a latent image formed on the photoconductive member 2M by influence of a developing electric field, which is created by the latent image and a developing bias applied to the developing roller 22*a* at the developing position. Thus, the latent image is developed on the photoconductive member 2M.

When image formation is instructed from an operation section (not shown) in the above-mentioned printer the photoconductive members 2Y, 2M, 2C, and 2K are rotated in a direction shown by an arrow A by a driving source (not shown). Respective charge rollers 21Y, 21M, 21C, and 21K are given charge bias by a power source (not shown) and uniformly charge the photoconductive members 2Y, 2M, 2C, and 2K. Respective photoconductive members 2Y, 2M, 2C, and 2K are then exposed by laser lights modulated by image data of respective colors of Y, M, C, K, thereby forming latent images on the respective surfaces in the writing apparatus. These latent images become toner mages of respective colors of Y, M, C, K when developed by the developing devices 22Y, 22M, 22C, and 22K. One of transfer sheets P is separated and fed by the sheet feeding rollers 24 and 25 from selected one of the sheet feeding cassettes 12 and 13 toward a pair of sheet registration rollers 26 arranged upstream of the photoconductive member 3Y. The pair of registration rollers 26 launch the transfer sheet P onto the transfer belt 5 moving in a direction shown by an arrow B in synchronism with toner images formed on the respective photoconductive members 2Y, 2M, 2C, and 2K. Specifically, the transfer sheet P is launched onto the transfer belt 5 from between the driven roller 8 and attracting roller 10, and is conveyed to respective transfer stations with it being electrostatically attracted to the transfer belt 5 by a bias voltage applied to the sheet attracting roller 10.

Respective toner images of Y, M, C, and K colors on the photoconductive members 2Y, 2M, 2C, and 2K are superimposed onto the transfer sheet P by the transfer brushes 9Y, 9M, 9C, and 9K in turn when the transfer sheet P passes through the respective transfer stations. Thus, a full color toner image having four-color superposition is formed and is then fixed on the transfer sheet P by the fixing apparatus 11. The transfer sheet P is then either inverted and ejected onto the ejection tray 18 or advances straight from the fixing apparatus 11 and is conveyed to respective transfer stations again through the inversion unit 15 and the duplex unit 14 at a prescribed time via the conveyance path in accordance with a designated mode. Toner remaining after the toner transfer process on the photoconductive members 2Y, 2M, 2C, and 2K is collected by the cleaning devices 23Y, 23M, 23C, and 23K, and is conveyed toward a discard toner conveyance coil. The toner is then conveyed to a discard toner ejection outlet by the discard toner conveyance coil, and is collected into a discard toner bottle (not shown) When a monochrome image is to be printed, only a black toner image is formed on the photoconductive member drum 2K. Then, the transfer belt 5 conveys a transfer sheet P in synchronism with the toner image, and the transfer sheet P receives transfer of the black toner image.

Figure 2:
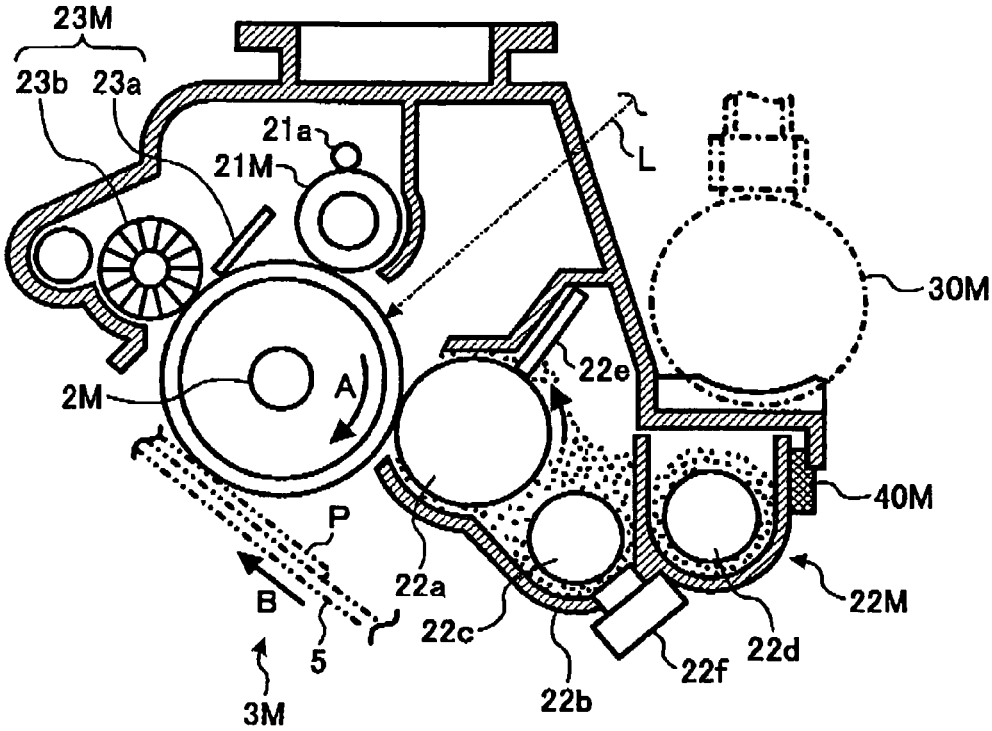
FIG. 2 illustrates an exemplary photoconductive member unit employed in the printer of FIG. 1.
Figure 3:
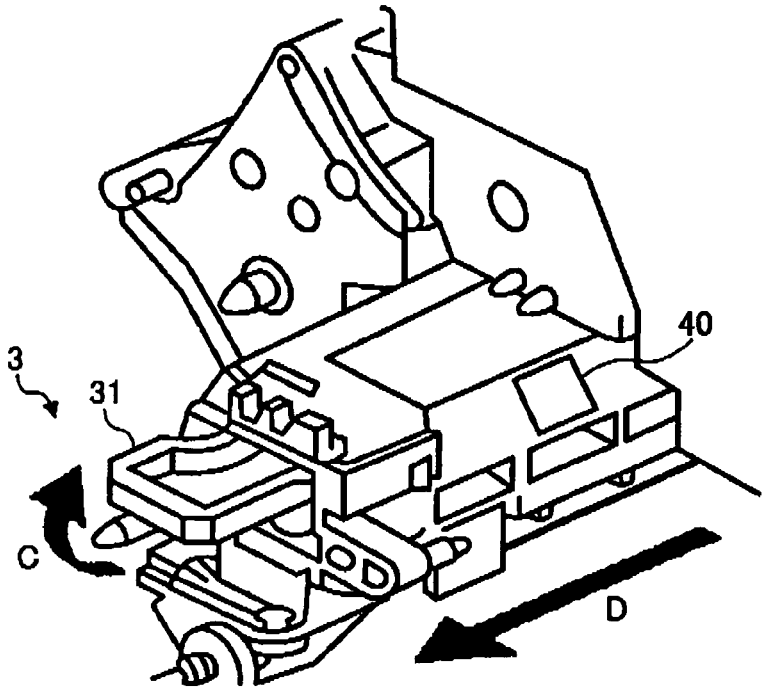
FIG. 3 illustrates an exemplary condition when the photoconductive member unit of FIG. 2 is drawn from an image forming apparatus.

The respective photoconductive member units 3Y, 3M, 3C, and 3K constitute process cartridges detachably attached to the image forming apparatus 1. As shown in FIG. 2, the photoconductive member unit 3M integrally mounts the photoconductive member 2M, the charge roller 21M, the developing device 22M, and the cleaning device 23M, and is detachably attached to the image forming apparatus. Thus, the photoconductive member 2 or the like is separately replaced to increase maintainability by enabling the photoconductive member unit 3 to be detachably attached to the image forming apparatus 1. As shown in FIG. 3, when the photoconductive member unit 3 is to be drawn from the image forming apparatus 1, a lever 31 is inclined in a direction opposite to an arrow C, so that the photoconductive member unit 3 becomes readily drawn in a direction shown by an arrow D. When the photoconductive member unit 3 remains in the image forming apparatus 1, the lever 31 is bent in a direction shown by the arrow C, i.e., upwardly.

Further, an IC tag 40 is attached to the right side plate of the photoconductive member unit 3 in the drawing. The IC tag 40 includes an IC chip 41 having an EEPROM 42 as a non-volatile device on a print substrate. The EEPROM 42 stores information necessary in controlling the photoconductive member unit 3 and its component parts, for example, image formation conditions, such as an exposure amount, a charge amount, a developing bias amount, etc. Also stored in the EEPROM 42 are a process cartridge lot, a manufactured date, a type, a storage period, a usable date, used hours, a usage duration guarantee, an identification number, a usage starting date, a number of copies, a usage limiting number of copies, a number of recycles, and a limiting number of recycles of a photoconductive member unit, or the like. Also stored in the EEPROM 42 are a time of replacing a component part (i.e., a replaceable member) of a photoconductive member unit, information of parts to be replaced at a time of recycling, information of a part newly installed at the time of recycling, a code of a part coming the end of life, a number of rotations of a rotation member for detecting a life, and a usage limiting number of rotations of a rotation member. Also stored in the EEPROM 42 are a toner lot, a manufactured date, toner remaining and filling amounts, a type, a storage period, a number of recycles, and a limiting number of recycles of a toner cartridge, or the like. Further, unit abnormalities, such as T-sensor abnormality, charge abnormality, etc., can be stored in the EEPROM 42 to be checked when being recycled, and to consider parts replacement.

Figure 4:
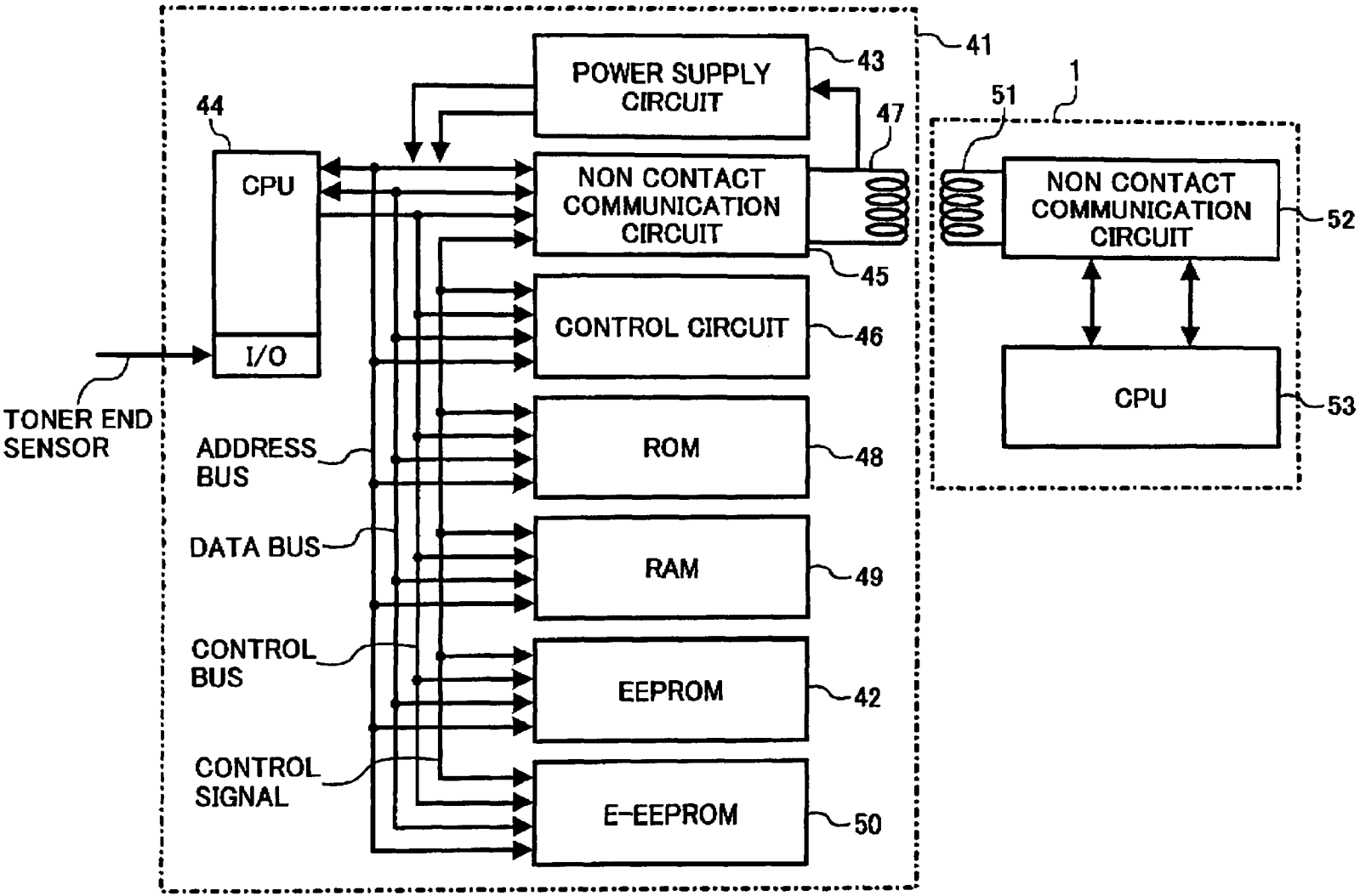
FIG. 4 illustrates an exemplary connection between a non-contact type IC chip mounted on an IC tag and the image forming apparatus.

An exemplary connection between a non-contact type IC chip mounted on an IC tag and an image forming apparatus are now described with reference to FIG. 4. As shown, the IC chip 41 includes a power supply circuit 43, a CPU 44, a non-contact communications circuit 45, a control circuit 46, and a communications antenna 47 that executes non-contact communications with an image forming apparatus 1. The power source circuit 43 rectifies electromagnetic waves of the communications antenna 47, and supplies power to the above-mentioned circuits. The IC chip 41 further includes a ROM 48 as a program memory, a RAM 49 that executes program as a working memory, the EEPROM 42 as a non-volatile device that stores information necessary to control the photoconductive member unit 3 as mentioned above, and an E-EEPROM 50 that stores a private instruction to write in the EEPROM 42. The CPU 44 includes an I/O port and receives an output of a toner end sensor. Further, the image forming apparatus 1 includes a communications antenna 51 that executes non-contact communications with the IC chip 41, a non-contact communications circuit 52, and a CPU 53. The non-contact communications circuit 52 and the CPU 53 communicate signals with each other by means of a serial communications interface. Even if the IC tag 40 is described only as to the photoconductive member unit 3 in the above, each of four photoconductive member units 3Y, 3M, 3C, and 3K includes an IC tag 40, and four non-contact communications circuits 52 are correspondingly employed in the image forming apparatus 1.

Non-contact communications are executed between the IC chip and the image forming apparatus 1 as follows. Initially, a signal outputted from the CPU 53 is modulated into a prescribed signal for transmission use by the non-contact communications circuit 52, and is transmitted to the communications antenna 51. The communications antenna 42 receives a signal transmitted from the communications antenna 51. Then, the signal is demodulated from the prescribed signal of transmission use and is then converted into a parallel signal by the non-contact communications circuit 45. The signal is then transmitted to the CPU 44. The CPU 44 reads information from the EEPROM 42 in response to the signal transmitted from the image forming apparatus 1, and executes calculation using prescribed program installed in the ROM 48, and writes the calculation result in the EEPROM 42. Further, the CPU 44 transmits calculation result from the non-contact communications circuit 45 to the image forming apparatus 1.

Even though the memory tag 40 of the non-contact type is described in the above, a contact type memory tag can be employed. When the contact type memory is employed, only a connection terminal is newly employed instead of the communications antennas. Specifically, the remaining configuration is the same.

Figure 5:
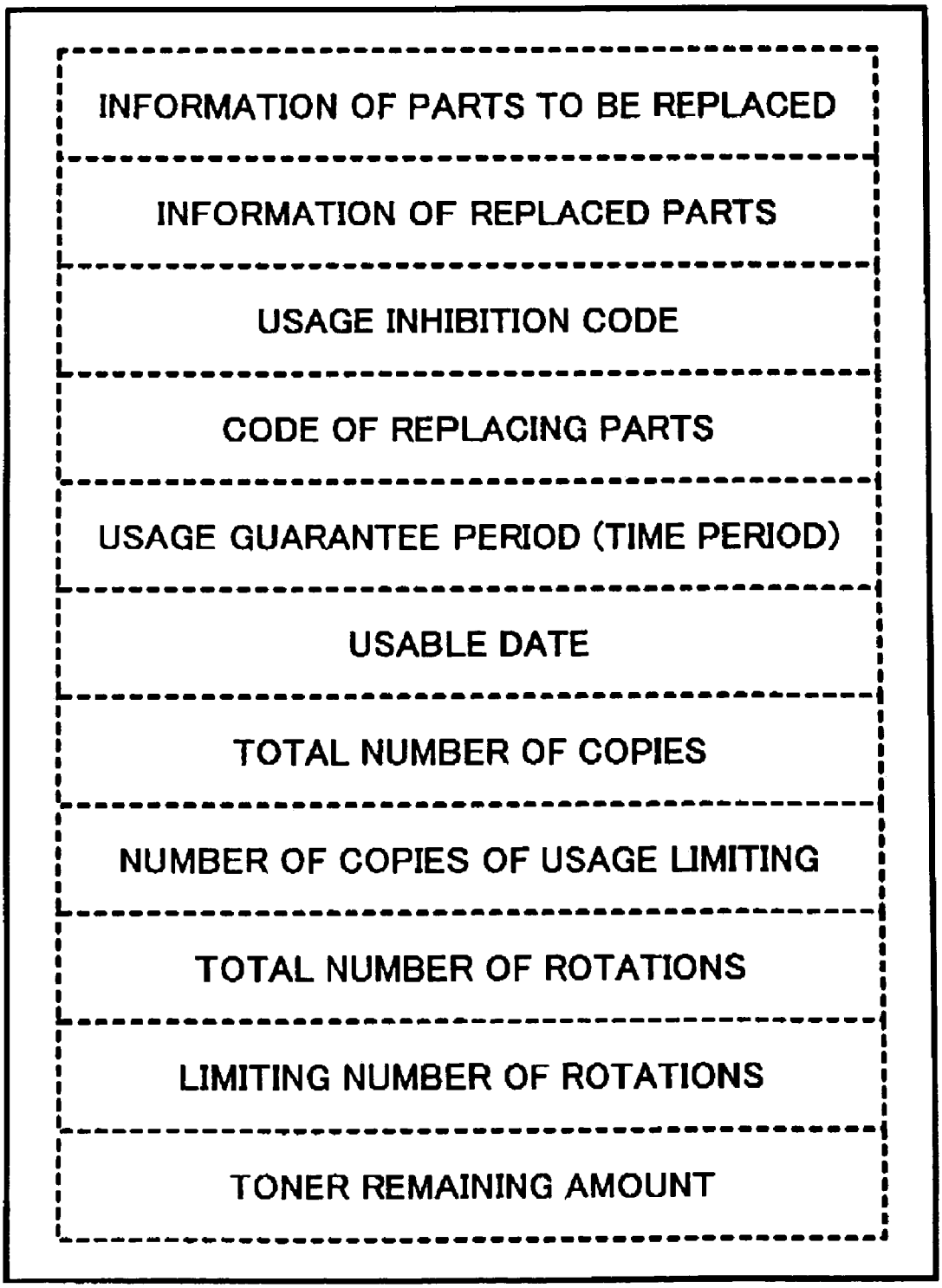
FIG. 5 illustrates an exemplary memory map of an EEPROM mounted on the IC tag.

Now, an exemplary memory map of the EEPROM is described according to one embodiment of the present invention with reference to FIG. 5. A CPU 44 serving as a life detection device reads information stored in the EEPROM 42 and detects a life of each of the photoconductive member unit 3 and its component parts serving as replacement parts. For example, by comparing used hours with a usage guaranteed period, used date with usable date (i.e., usage guaranteed period), a total number of copies with a usage limiting number of copies, a total number of rotations of a rotation member with a limiting number of rotations, lives of the photoconductive member unit 3 and the part are detected. Also, the lives can be detected based upon a toner remaining amount or the like. When an operational condition, such as quality of an image of a printer, etc., is guaranteed in view of the detection result, the CPU 44 writes a usage inhibition code in the EPPROM 42 to ban usage of the photoconductive member unit 3 any more as a usage inhibition code writing device. The CPU 44 writes a code of a part to be replaced in the EEPROM 42 as a replaceable member code writing device. Further, when the photoconductive member unit 3 is to be recycled, the usage inhibition code is erased, a part is replaced in accordance with the information of a part to be replaced, and information of a newly installed part is stored, thereby quality and credibility of the recycled photoconductive member unit 3 is guaranteed. The life of the photoconductive member unit 3 is supposed to come to the end when life of an unreplaceable part included in the photoconductive member unit comes to end. Further, the reason why the photoconductive member unit 3 and the individual part independently calculate used hours, a usage date, and a total number of copies is that a part is expected to be replaced.

Figure 6A:
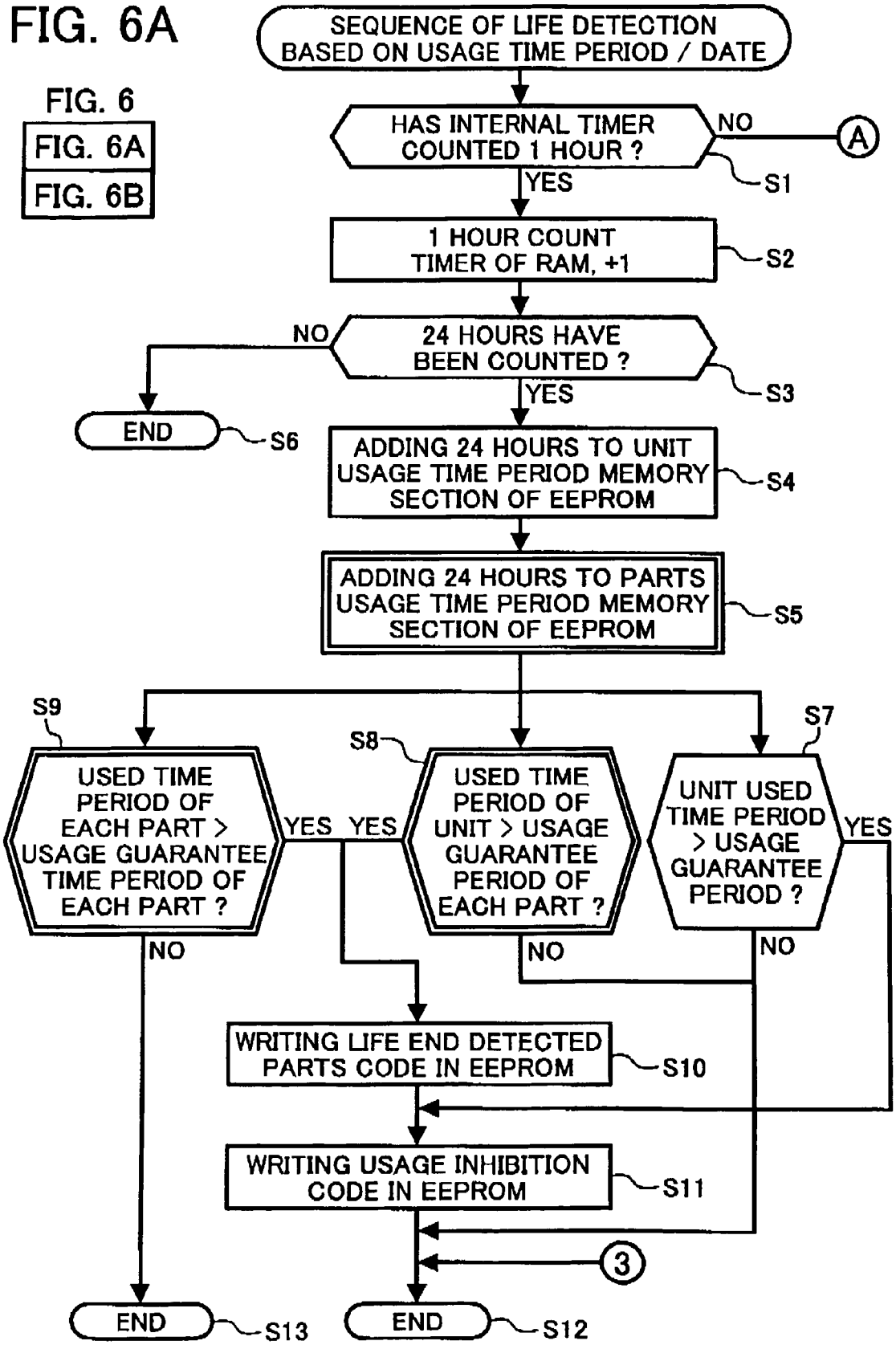
FIGS. 6A and 6B collectively illustrate an exemplary sequence of detecting lives of a unit and a part based upon usage time and date.
Figure 6B:
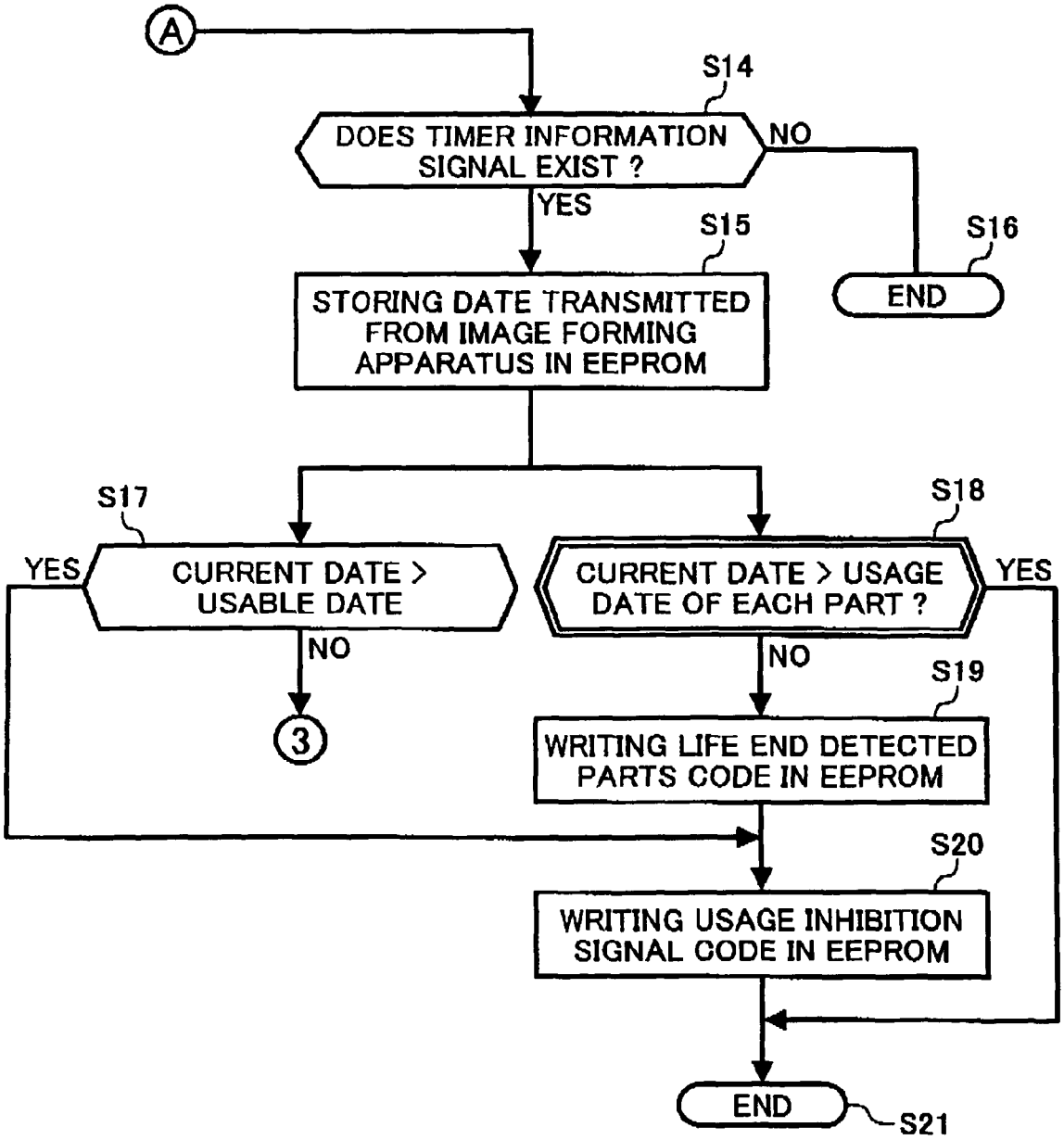

Initially, detection of lives of the photoconductive member unit 3 and parts installed therein based upon used hours and a usage date are described with reference to FIG. 6. As shown, it is initially checked if a counter of an interior timer of the CPU 44 in the IC chip 41 has counted one hour in step S1. If it is positive (i.e., Yes, in step S1), one hour is added to a count of the count timer of the RAM 49 in step S2. Since information of the RAM 49 disappears when the power supply is turned off, this time represents actual working hours. Subsequently, it is checked if the count timer of the RAM 49 has counted a prescribed hours, such as 24 hours, etc., in step S3. If it is positive (i.e., Yes, in step S3), 24 hours are added to a unit usage hour memory section in the EEPROM 42 in step S4. Further, 24 hours is also added to a part usage hour memory section arranged per part in the EEPROM 42 in step S5. Since information of the usage hour memory section does not disappear even when the power supply is turned off, this usage time represents accumulated used hours. If the counter timer of the RAM 49 has not yet counted 24 hours (i.e., No, in step 2), the process is terminated in step S6. Subsequently, the accumulated used hour of the photoconductive member unit 3 stored in the EEPROM 42 and the usage guaranteed hours thereof previously written in the EEPROM 42 are read and compared with each other by the CPU 44 in step S7.

When the accumulated used hours exceed the usage guaranteed hours (i.e., Yes, in step 7), it is determined that the life of the photoconductive member unit 3 has expired, and a usage inhibition code is written in the EEPROM 42 in step S11. Then, the process is terminated in step S12. When the accumulated used hours does not exceed the usage guaranteed hours (i.e., No, in step 7), the process is terminated in step S12. Further, the accumulated used hours of the photoconductive member unit 3 stored in the EEPROM 42 and the usage guaranteed hours of each of the parts previously written in the EEPROM 42 are read and compared with each other by the CPU 44 in step S8. When the accumulated used hours exceed the usage guaranteed hours of each of the parts (i.e., Yes, in step 8), a code of the part recognized as coming to the end of life is written into the EEPROM 42 in step S10. A usage inhibition code is written into the EEPROM 42 in step S11, and the process is terminated in step S12. In contrast, when the accumulated used hours do not exceed the usage guaranteed hours of each of the parts (i.e., No, in step 8), the process is terminated in step S12. Further, the accumulated used hour of each of the parts stored in the EEPROM 42 and the usage guaranteed hours of each of the parts previously written in the EEPROM 42 are read, and are compared with each other by the CPU 44 in step S8. As a result, when the accumulated used hours of one or more of the parts exceed the usage guaranteed hours thereof (i.e., Yes, in step 9), a code of the part, which life is detected, is written into the EEPROM 42 in step S10. Then, a usage inhibition code is written into the EEPROM 42 in step S11, and the process is terminated in step S12. In contrast, when the accumulated used hours of the photoconductive member unit 3 does not exceed the usage guaranteed hours of each of the parts (i.e., No, in step 9), the process is terminated in step S12.

Back to step S1, when the counter of the internal timer of the CPU 44 has not yet counted one hour (i.e., No, in step S1), it is determined if the image forming apparatus 1 transmits a timer information signal (e.g. a date signal) in step S14. When the determination is positive (i.e., Yes, in step S14), a current date transmitted from the image forming apparatus 1 is stored in the EEPROM 42 (in step S15). When the image forming apparatus 1 does not transmit the timer information signal (i.e., No, in step S14), the process is terminated in step S16. Subsequently, a current date stored in the EPPROM 42 and a usable date of the photoconductive member unit 3 stored therein are compared by the CPU 44 in step S17. When the current date exceeds the usable date of the photoconductive member unit 3 (i.e., Yes, in step S17), it is determined that the photoconductive member unit has come to end of the life, and a usage inhibition code is written into the EEPROM 42, and the process is terminated in step S21. In contrast, when the current date does not exceed the usable date of the photoconductive member unit 3 (i.e., No, in step S17), the process is terminated in step S21. Further, a current date stored in the EPPROM 42 is compared with a usable date of each of parts stored therein by the CPU 44 in step S18. When the current date exceeds the usable date (i.e., Yes, in step S18) of one or more of those, it is determined that the applicable part has come to end of the life, and a code of the part is written into the EEPROM 42 in step S19. A usage inhibition code is written in to the EEPROM 42 in step S20, and the process is then terminated in step S21. In contrast, when the current date does not exceed the usable date of each of the part (i.e., No, in step S18), the process is terminated in step S21.

Now, detection of lives of the photoconductive member unit 3 and parts based upon a number of rotations of a rotation member (herein after referred to as a roller) and a total number of copies are described. In general, life of a part, such as developing, transferring, and charging rollers, etc., correlates to a total number of rotations thereof. Thus, life of each of rollers is preferably detected by comparing a total number of rotations of each rollers, directly detected or calculated based upon the total number of rotations of a photoconductive member, with a limiting number of rotations previously stored in a memory. It is of course that the life can be detected based upon the total number of copies. Life of a part, such as a cleaning blade, etc., generally correlates to a number of copies. Thus, it is preferable that a total number of copies is compared with a previously stored limiting number of copies to detect the life of the cleaning blade.

Figures 7, 7A, 7B:
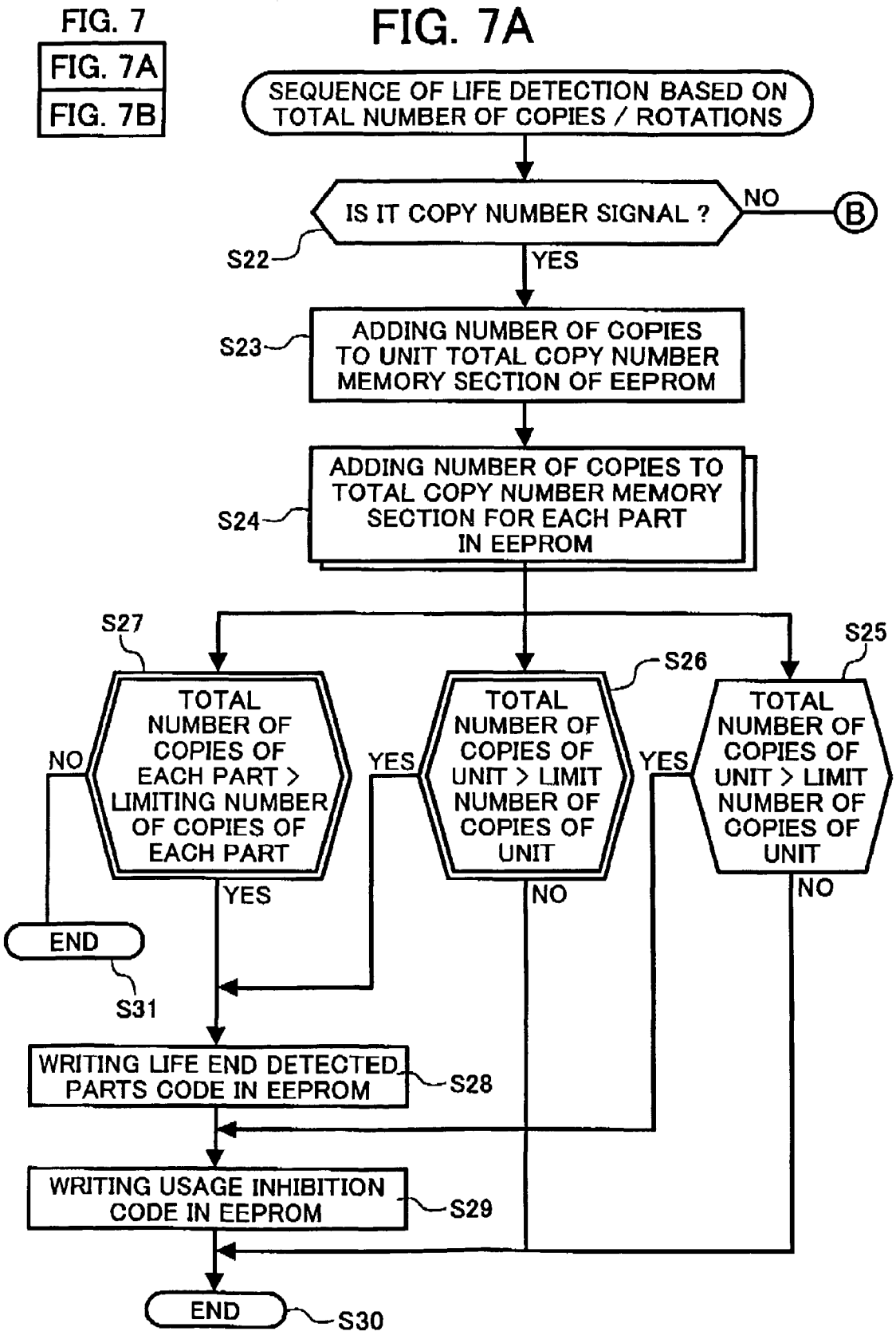
FIGS. 7A and 7B collectively illustrate an exemplary sequence of detecting lives of a unit and a part based upon a total number of copies and that of rotations of a roller.
Figure 7B:
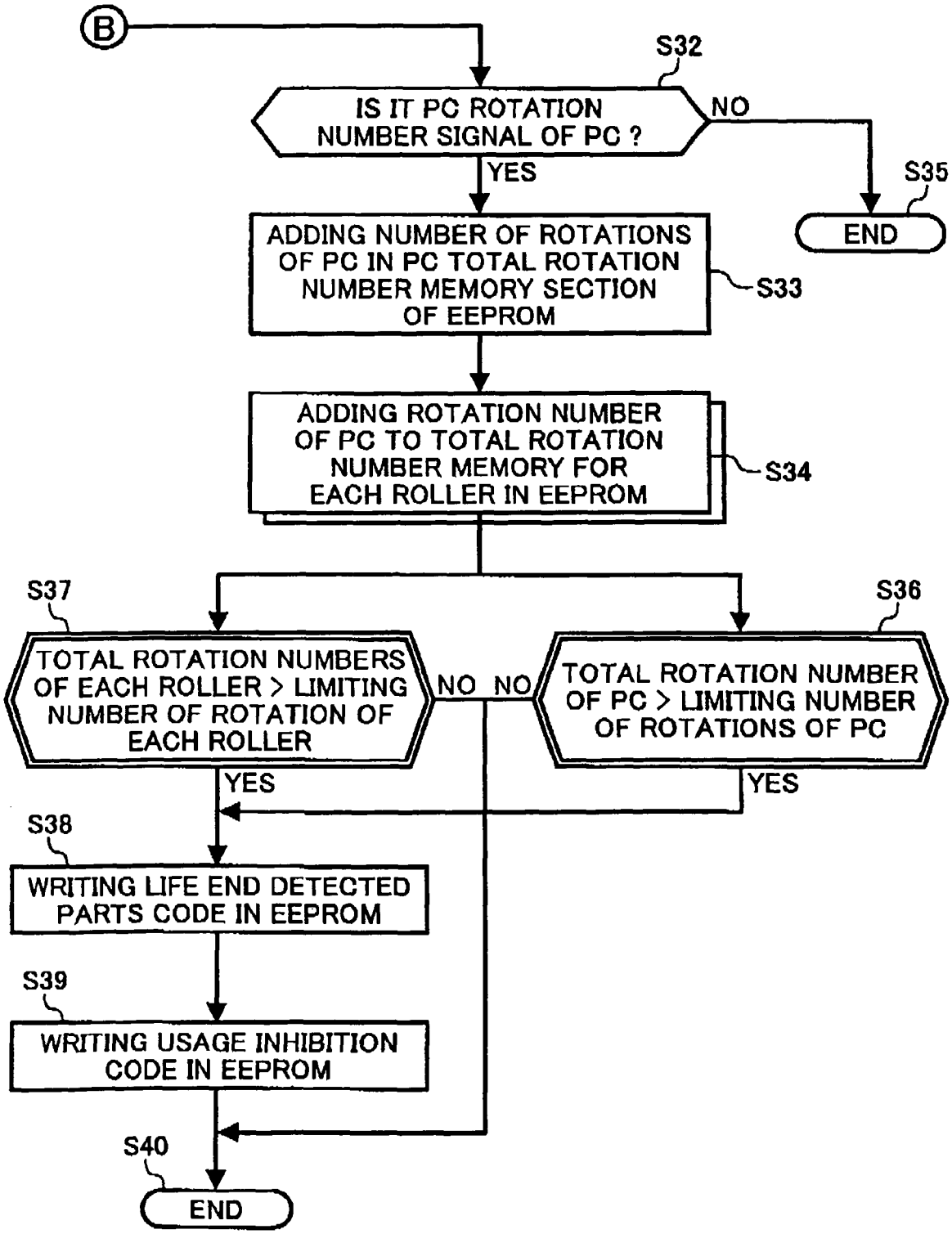

A sequence of detecting each of lives of a photoconductive member unit 3 and parts based upon the total number of copies and that of rotations of a roller is now described with reference to FIG. 7. As shown, Initially, it is checked if the image forming apparatus 1 transmits a copy number signal in step S22. If the checking result is positive (i.e., Yes, in step S22), a number of copies transmitted from the image forming apparatus is added to a unit total copy number memory section in the EPPROM 42 in step S23. Then, the number of copies is also added to a total copy number memory section arranged per part in the EEPROM 42 in step S24. Then, the total number of copies of the photoconductive member unit stored in the EEPROM 42 and the usage limiting number of copies of the photoconductive member unit 3 previously written in the EEPROM 42 are read and compared with each other by the CPU 44 in step S25. As a result, when the total copy number exceeds the usage limiting copy number of the photoconductive member unit 3 (i.e., Yes, in step S25), it is determined that the photoconductive member unit 3 has come to end of the life, and a usage inhibition code is written into the EEPROM 42 in step S29. The process is terminated in step S30.

In contrast, when the total copy number does not exceed the usage limiting copy number (i.e., No, in step S25), the process is terminated in step S30. Further, the total copy number stored in the EEPROM 42 and the usage limiting copy number previously stored in the EEPROM 42 each for the photoconductive member unit are compared with each other by the CPU 44 in step S26. When the total copy number exceeds the usage limiting copy number (i.e., Yes, in step S26), it is determined that the photoconductive member unit has come to end of the life, and a code of the photoconductive member unit is written into the EEPROM 42 in step S28. Then, a usage inhibition code is written in the EEPROM (in step S29), and the process is terminated in step S30. Further, the total copy number stored in the EEPROM 42 per part and the usage limiting copy number previously stored in the EEPROM 42 per part are compared with each other by the CPU 44 in step S27. When the total copy number of the individual part exceeds the usage limiting copy number of the part (i.e., Yes, in step S27), it is determined that the part has come to end of the life, and a code of the part is written into the EEPROM 42 in step S28. Then, a usage inhibition code is written in the EEPROM (in step S29), and the process is terminated in step S20. When the total copy number of the individual part does not exceed the usage limiting copy number thereof (i.e., No, in step S27), the process is terminated in step S31.

Back to step S22, when a signal transmitted from the image forming apparatus 1 is not a copy number signal (No, in step S22), it is determined if the signal relates to a number of rotations of the photoconductive member 2 (in step S32). When it is positive (i.e., Yes, in step S32), a rotation number of the photoconductive member 2 is added to the photoconductive member total rotation number memory section in the EEPROM 42 in step S33. Then, a photoconductive member rotation number transmitted from the image forming apparatus 1 is also added to a roller total rotation number memory section arranged per roller in the EEPROM 42 in step S34. In contrast, when a signal transmitted from the image forming apparatus 1 is not a rotation number signal (No, in step S32), the process is terminated in step S25. Then, the total number of rotations of the photoconductive member 2 stored in the EEPROM 42 and the usage limiting number of rotations the photoconductive member 2 previously stored (in the EEPROM 42) are compared with each other by the CPU 44 in step S36. When the total rotation number of the photoconductive member 2 exceeds the usage limiting rotation number (i.e., Yes, in step S36), it is determined that the photoconductive member 2 comes to end of the life, and a code of the photoconductive member 2 detected as coming to end of the life is written into the EEPROM 42 in step S38. Then, a usage inhibition code is written in the EEPROM in step S39, and the process is terminated in step S40. Further, a total number of rotations stored per roller in the EEPROM 42 and a usage limiting number of rotations previously stored in the EEPROM 42 per a roller are compared with each other by the CPU 44 in step S37. When the total rotation number of one or more of the rollers exceed the usage limiting rotation number thereof (i.e., Yes, in step S37), it is determined that the roller has come to end of the life, and a code of the part is written into a non-volatile memory device in step S38. Then, a usage inhibition code is written in the EEPROM in step S39, and the process is terminated in step S40.

Figure 8:
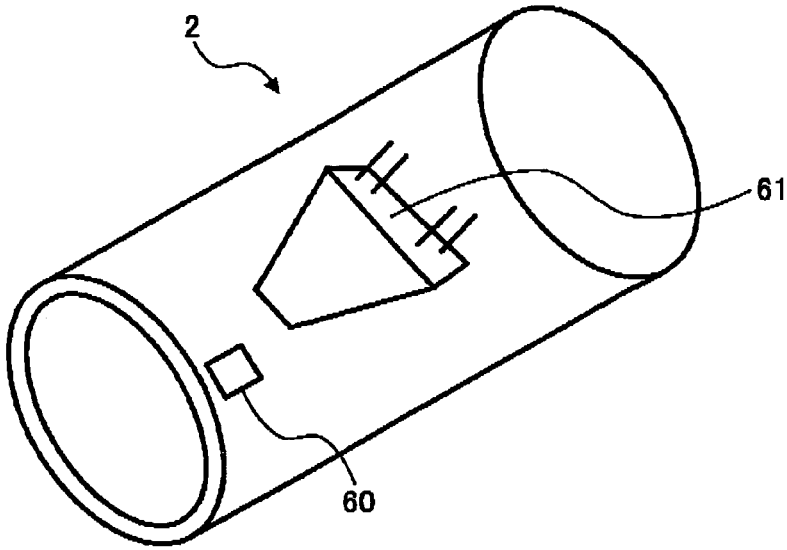
FIG. 8 illustrates an exemplary reflection type optical sensor that detects a number of rotations of a photoconductive member.
Figure 9:
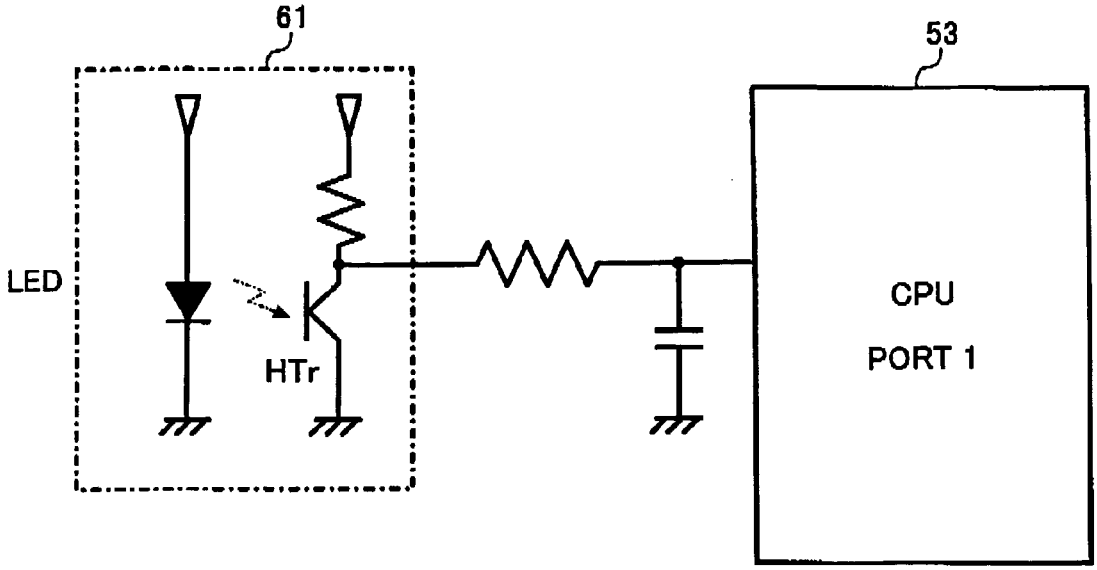
FIG. 9 illustrates an exemplary detection circuit that detects a drum rotation detection mark using the reflection type optical sensor.

To detect a number of rotations of the photoconductive member 2, a reflection type optical sensor can be employed as shown in FIG. 8. As shown there, a drum rotation detection mark 60 is arranged in an outside of an image formation region of the photoconductive member 2. A reflection type optical sensor 61 is arranged around the periphery of the photoconductive member 2 to detect the drum rotation detection mark 60 per rotation of the photoconductive member 2. A detection circuit that detects a drum rotation detection mark by means of the reflection type optical sensor is described with reference to FIG. 9. As shown, a drum rotation signal transmitted from the reflection type optical sensor 61 is transmitted to the CPU 53 arranged on the side of the image forming apparatus 1 via the I/O port. The CPU 53 counts the drum rotation signals to detect a number of rotations of the photoconductive member 2, and transmits the number to the IC chip 41 arranged on the side of the photoconductive member unit 3. The drum rotation signal can be transmitted to the CPU 44 arranged on the side of the unit 3. The life of a roller is detected based upon a number of rotations of the photoconductive member 2 in the example of FIG. 8. However, a rotation number detecting device can be arranged to each of the rollers, and life of each of the rollers can be directly detected based upon a number of rotations detected by the rotation number detecting device.

Figure 10:
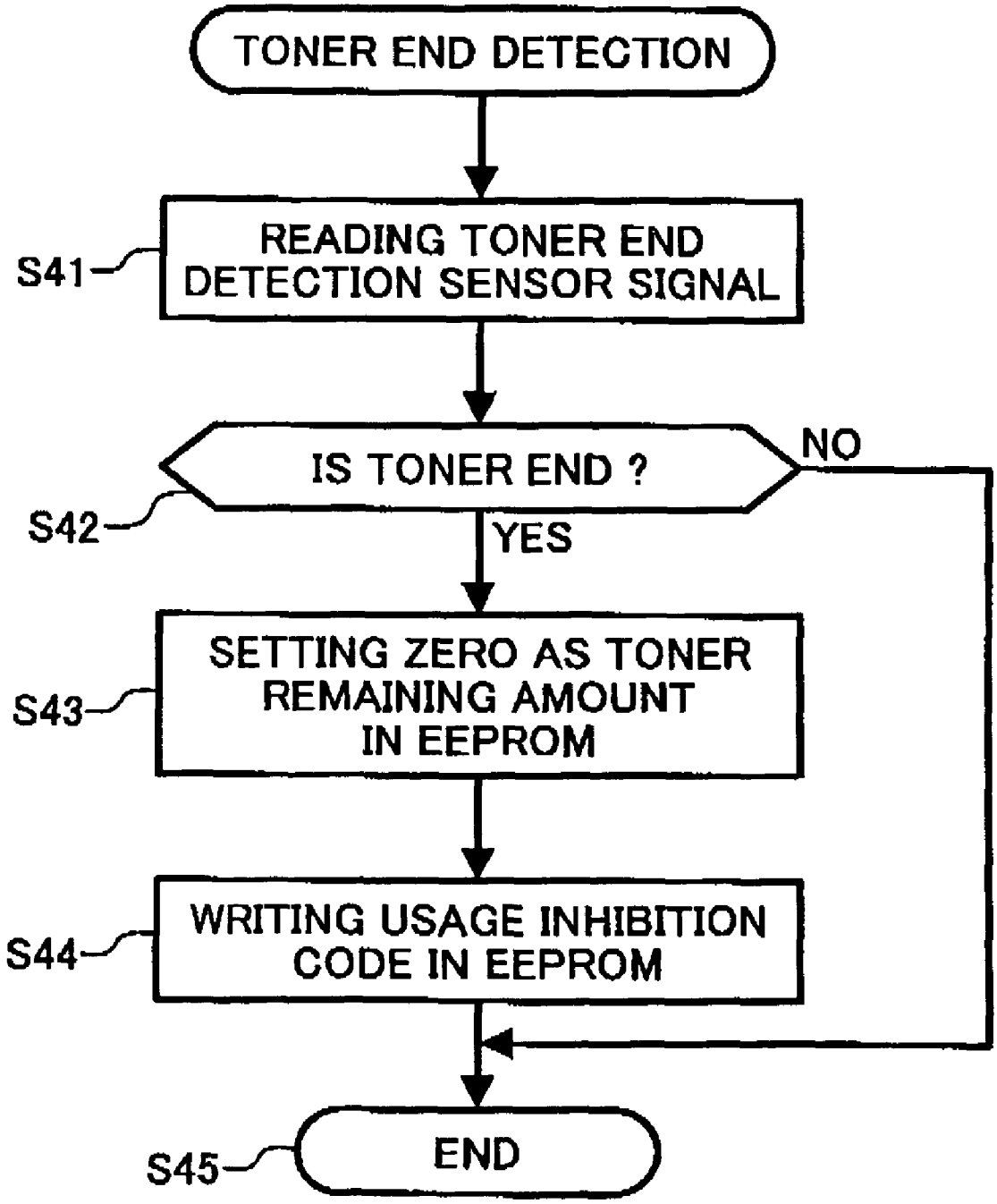
FIG. 10 illustrates an exemplary sequence of detecting a life of a unit based upon detection of a toner end detection sensor.

Further, life can be detected based on detection of a toner end detection device that detects end of toner stored in a toner cartridge 30 of the photoconductive member unit 3. An exemplary sequence of detecting life of a unit based on detection of a toner end sensor is now described with reference to FIG. 10. Initially, the CPU 44 reads an output signal transmitted from the toner end sensor through the I/O port connected to the toner end sensor in step S41. The CPU 44 then determines if the output signal is a toner end signal in step S42. If the determination is positive (i.e., Yes, in step S42), the CPU stores data indicating that toner remaining amount is zero in the EEPROM 42 in step S43. The CPU 44 then writes a usage inhibition code in the EEPROM 42 in step 44, and terminates the process in step S45. To the contrary, if the determination is negative (No, in step S42), the CPU 44 terminates the process in step S45. In the above, the CPU 53 of the image forming apparatus 1 can read a toner end signal transmitted from the toner end sensor.

Figure 11:
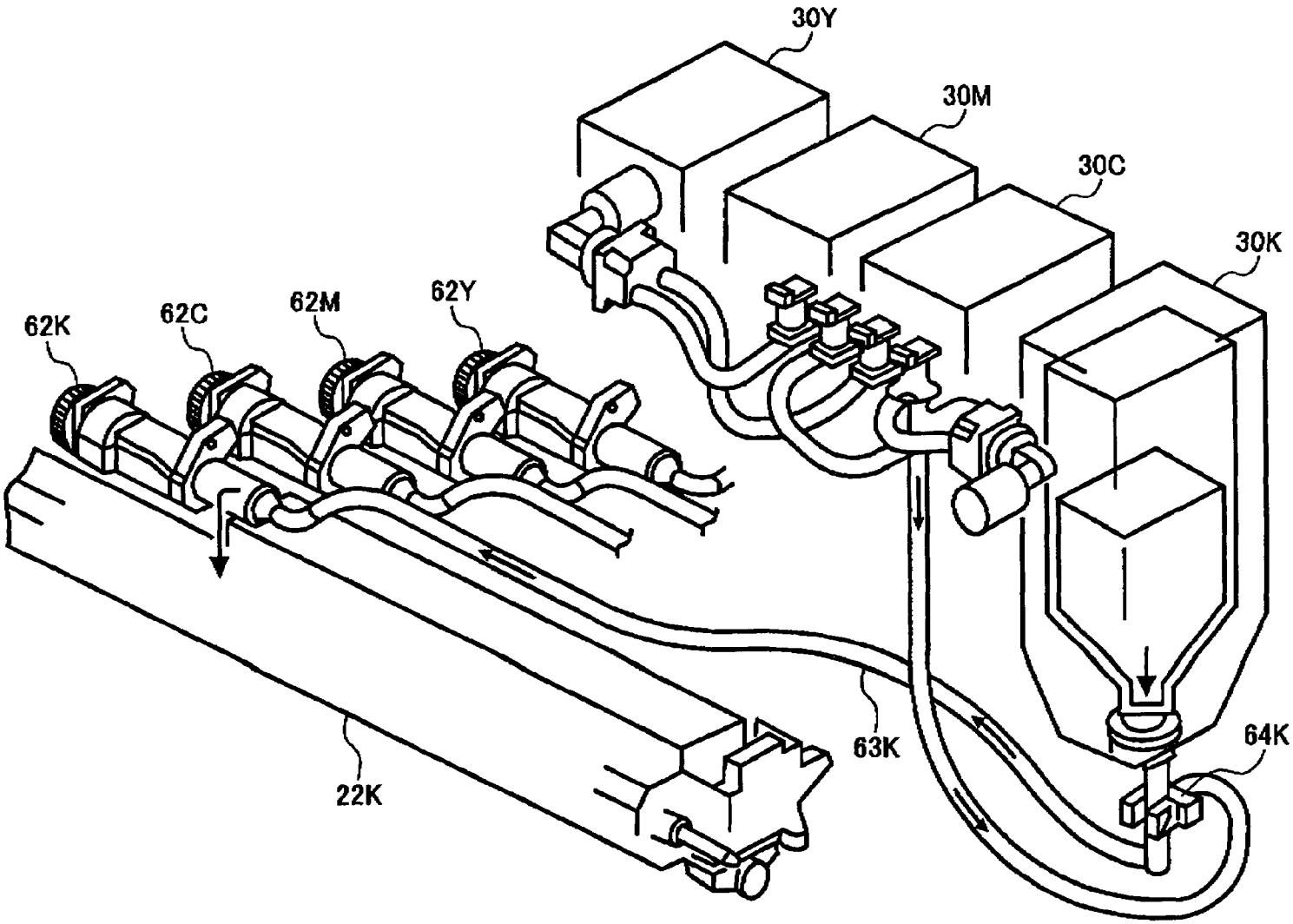
FIG. 11 illustrates an exemplary developing device and an exemplary toner cartridge.

To detect toner end, a transmission type optical sensor is preferably employed. Exemplary configurations of a developing device and toner cartridge are now described with reference to FIG. 11. A shown, toner stored in toner cartridges 30Y, 30M, 30C, and 30K is supplied to the developing devices 22Y, 22M, 22C, and 22K via the conveyance nozzles 63Y, 63M, 63C, and 63K by a mohno-pump 62Y. A plurality of transmission type optical sensors 64Y, 64M, 64C, and 64K are arranged at the end of the respective conveyance nozzles 63Y, 63M, 63C, and 63K on the side of the toner cartridge 30 as toner end detection sensors. The transmission type optical sensor 64 detects transmittance to recognize toner end. However, a toner end sensor of an antenna system can be employed in the developing case 22*b* instead of the transmission type optical sensor 64. The antenna system toner end sensor detects an electrostatic capacity varying in accordance with an amount of toner between the developing roller 22*a* and the antenna to recognize toner end in the developing case 22*b*.

Figure 12:
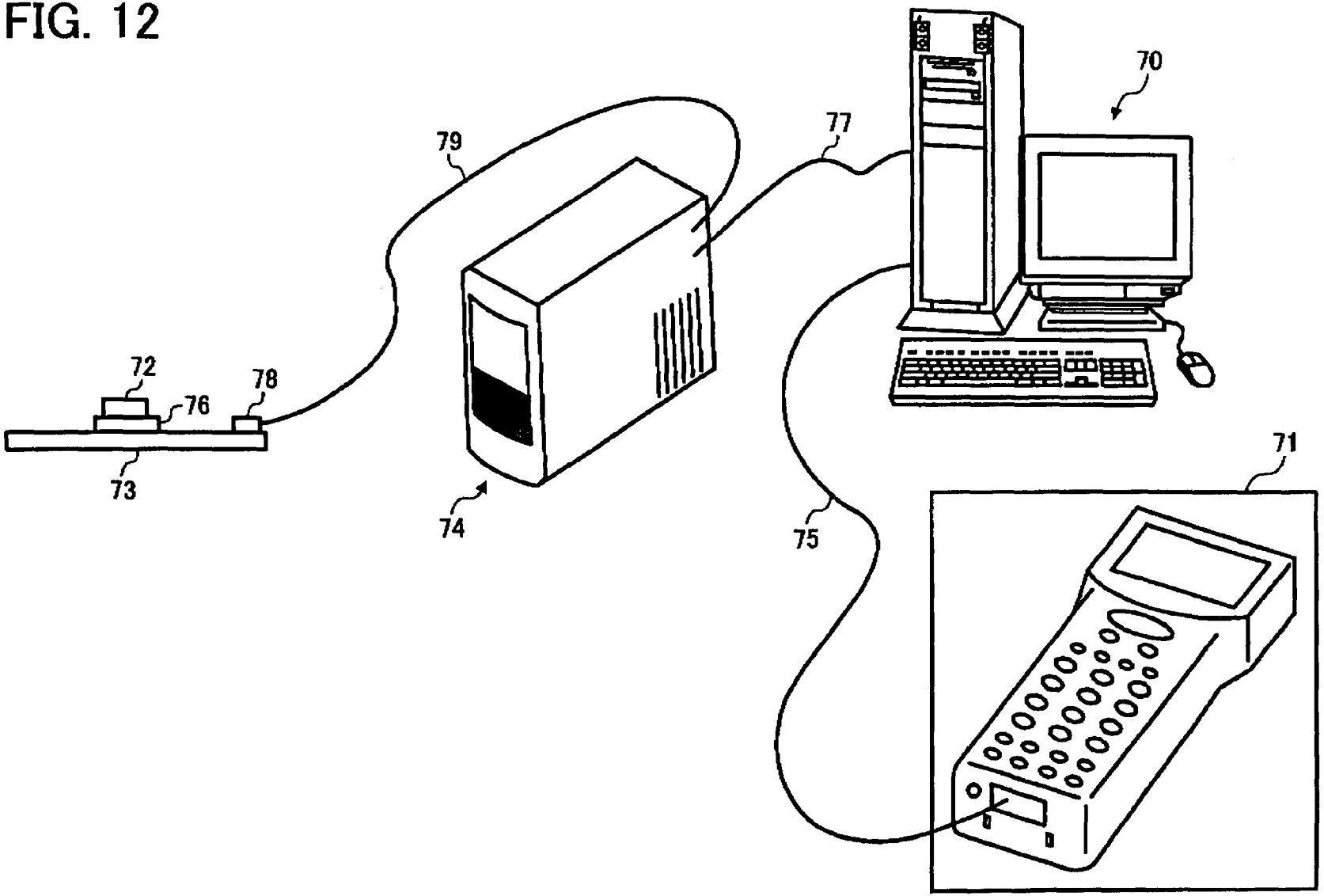
FIG. 12 illustrates an exemplary system that reads and writes the IC tag.

Now, a process for recycling a photoconductive member unit 3 having come to end of the life is described. A unit 3 having come to end of the life is detached from the image forming apparatus 1 by either a user or a service person and is conveyed to a recycle factory. In the recycling factory, Life information of a part having come to end of the life is read from the EEPROM 42 of the IC tag 40 and recycle information of a part newly installed is written their into. An exemplary apparatus for reading and writing from and to the IC tag is described with reference to FIG. 12. A shown, when the photoconductive member unit 3 is recycled, a personal computer 70, a handy type reader-writer 71 that communicates information with a non-contact type IC tag 40, an IC tag read-write board 73 that communicates information with a non-contact type IC tag 72, and an IC tag read-write apparatus 74 or the like are employed. The handy type reader-writer 71 is connected to the personal computer 70 via a USB 75 and is used when information of the non-contact type IC tag 40 is read and written. The IC tag read-write board 73 includes an IC tag use socket 76, to which the IC tag 72 is detachably mounted, and is used when recycle information is written into the IC tag 72 detached from the photoconductive member unit 3. The IC tag read-write apparatus 74 is connected to the personal computer 70 via a USB 77. Further, the IC tag read-write apparatus 74 is connected to the IC tag read-write board 73 via a connector 78 and an IC bus 79.

When the non-contact type IC tag 40 is used, the read-writer 71 executes communications with the IC tag 40 attached to the photoconductive member unit 3 so as to read Information, such as apart to be replaced, an abnormal career, a malfunction career, etc., used when a photoconductive member unit 3 is recycled, from the EEPROM 42. The information read is transmitted to the personal computer 70 via the read-writer 71. The photoconductive member unit 3 is recycled based on information transmitted to the personal computer 70. Then, the personal computer 70 writes recycling information, such as a replaced part, a recycled date, a number of recycle times, an amount of toner filled if any, a toner filling date, a valid term, a color toner ID if applicable, etc., into the EEPROM 42 of the IC tag 40 via the read-writer 71.

When the contact type IC tag 72 is employed, the IC tag 72 is detached from the photoconductive member unit 3, and is attached to the IC tag use socket 76. Then, communications with the IC tag read-write apparatus 74 is executed and information, such as apart to be replaced, an abnormal career, a malfunction career, etc., stored in the EEPROM is read to be used in recycling a unit. The information read in such a manner is transmitted to the personal computer 70 via the IC tag read-write apparatus 74. Then, the unit is recycled based upon the information. When the recycling of the unit is terminated, the personal computer 70 writes recycling information, such as a replaced part, a recycled date, a number of recycled times, an amount of toner filled if any, a toner filling date, a valid term, a color toner ID if applicable, etc., into the EEPROM of the IC tag 72 via the IC tag read-write apparatus 74. The IC tag 72 written the recycle information is detached from the IC tag use socket 76, and is attached again to the recycle photoconductive member unit 3.

Figures 13, 13A:
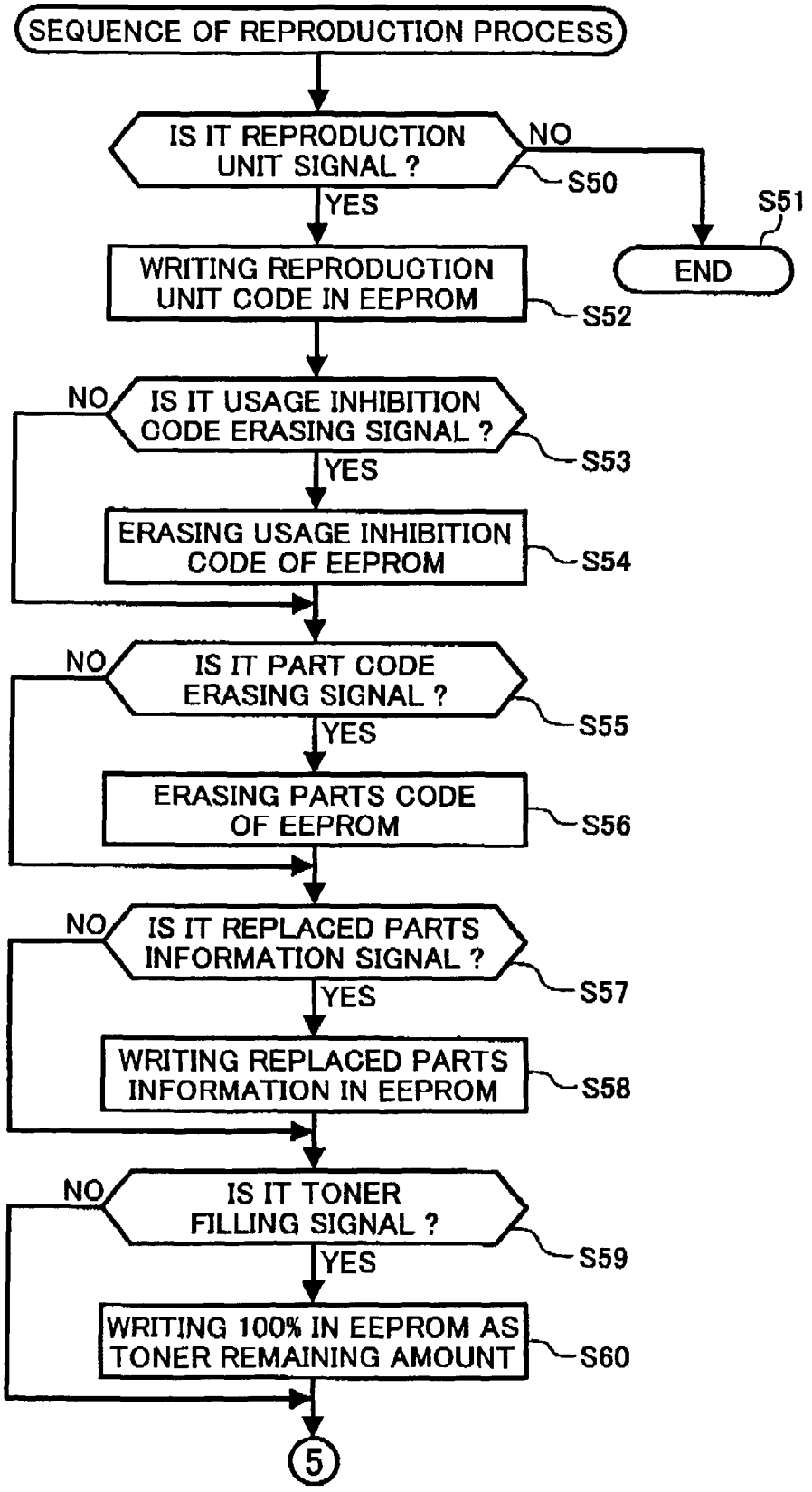
FIGS. 13A and 13B collectively illustrate an exemplary sequence of recycling a unit.
Figure 13B:
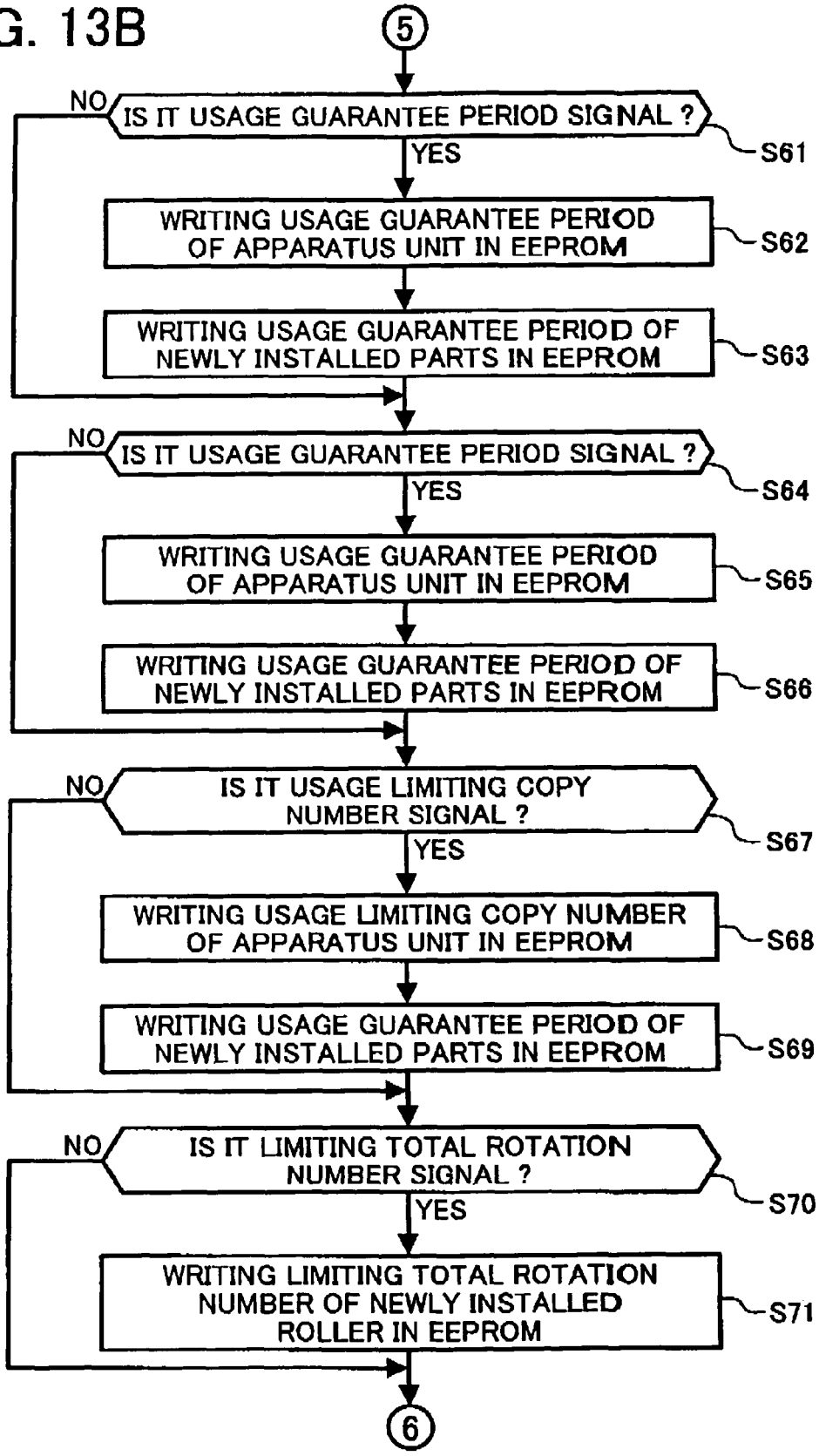
Figure 14:
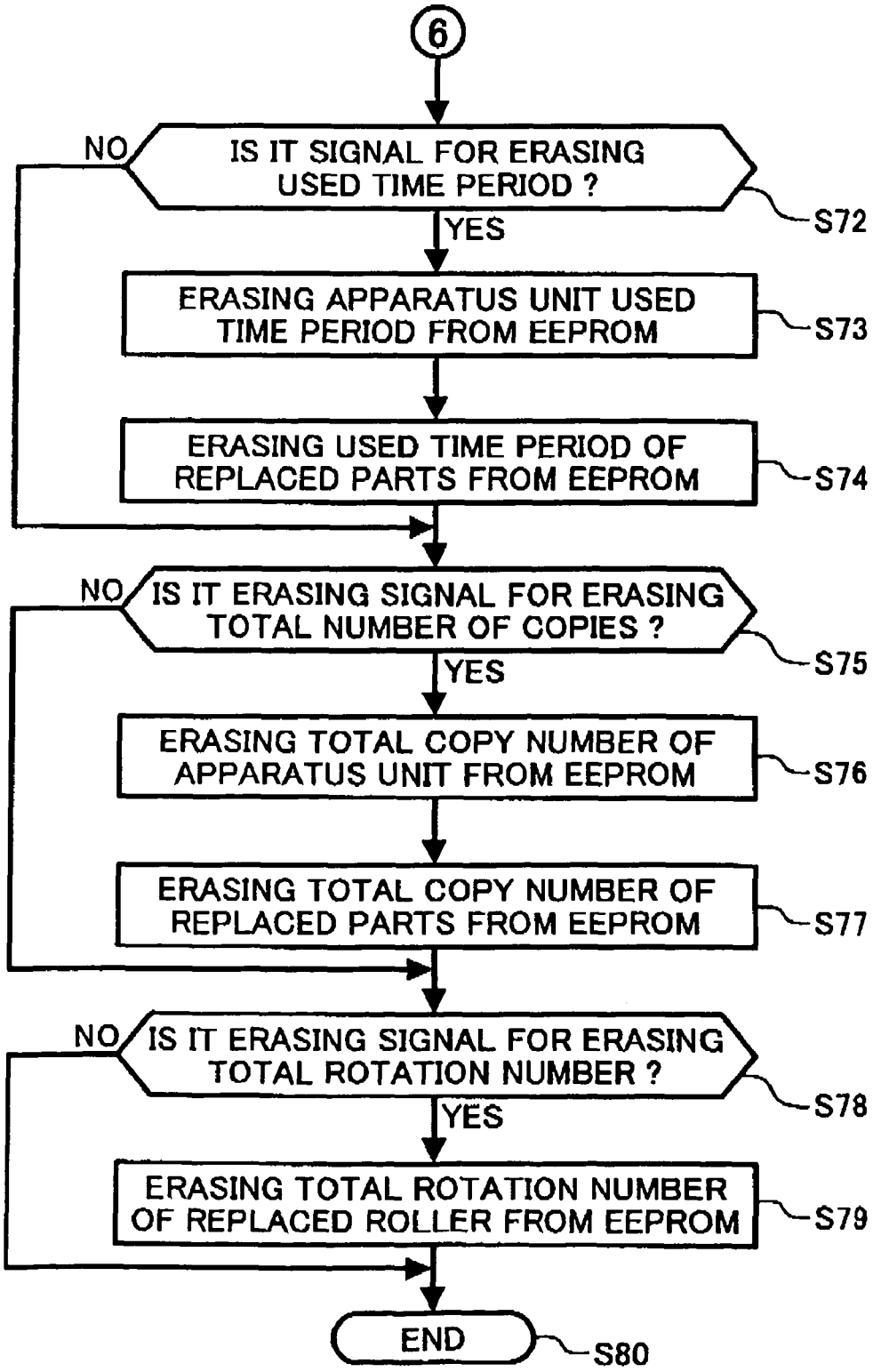
FIG. 14 illustrates another exemplary sequence of recycling a unit.

An exemplary sequence of recycling a photoconductive member unit is now described with reference to FIGS. 13 and 14. As shown in FIG. 13, the CPU 44 checks if a signal transmitted from the personal computer 70 (e.g. a handy read-writer 71 or an IC tag type read-write apparatus 74) relates to a recycle unit code signal in step S50. If the checking result is negative (i.e., No, in step S50), the process is terminated in step S51. When the checking result is positive (i.e., Yes, in step S50), are cycle unit code is written into the EEPROM 42 in step S52. The recycle unit code serves as a signal to be recognized that the photoconductive member unit 3 attached to the image forming apparatus 1 is a recycled unit. Then, it is checked if a usage inhibition code erase signal is included in step S52. When the checking result is positive (i.e., Yes, in step S52), a usage inhibition code written in to the EEPROM 42 is erased in step S54. Then, it is checked if a part code erase signal for erasing a cord of a part having come to end of the life is included in step S55. When the checking result is positive (i.e., Yes, in step S55), a part code stored into the EEPROM 42 is erased in step S56. Then, it is checked if a part information signal related to a newly installed part during recycling is included in step S57. If the checking result is positive (i.e., Yes, in step S57), the part information is written in to the EEPROM 42 in step S58. Then, it is checked if a toner filling signal is included in step S59. If the checking result is positive (i.e., Yes, in step S59), data of 100% is written in to a toner remaining memory section of the EEPROM 42 in step S60.

Further, a photoconductive member unit 3 is possibly recognized initially as coming to end of the life even still usable depending on a newly installed part, when a usage guaranteed term or the like is not changed. Then, a new usable guaranteed time period, usage guaranteed period (usable date), a usage limiting copy number, and a limiting rotation number, when a replacement part includes a photoconductive member or rollers, are set and rewritten for the photoconductive member unit 3 and the newly installed part. Specifically, it is first checked if a usage guaranteed period signal is included in step S61. If the checking result is positive (i.e., Yes, in step S61), a new usage guaranteed period for the new unit is written over the usage guaranteed period previously stored in the EEPROM 42 in step S62. Further, a new usage guaranteed period for the newly installed part is written over the usage guaranteed period previously stored in the EEPROM 42 in step S63. It is then checked if a usage guaranteed period signal is included in step S64. If the checking result is positive (i.e., Yes, in step S64), a new usage guaranteed period for the new unit is written over the usage guaranteed term previously stored in the EEPROM 42 in step S65. Then, a new usage guaranteed term for the newly installed part is written over the usage guaranteed period previously stored in the EEPROM 42 in step S66. It is then checked if a usage limiting copy number signal is included in step S67. If the checking result is positive (i.e., Yes, in step S67), a new usage limiting copy number for a new unit is written over the usage limiting copy number previously stored in the EEPROM 42 in step S68. Then, a new usage limiting copy number for a newly installed part is written over the usage limiting copy number previously stored in the EEPROM 42 in step S69. It is then checked if a limiting rotation number signal is included in step S70. If the checking result is positive (i.e., Yes, in step S70), a new limiting rotation number for a newly installed roller is written over the limiting rotation number previously stored in the EEPROM 42 in step S71.

Further, when the recycled unit is attached to the image forming apparatus 1, a used time period, a total copy number, a total rotation number of a roller are newly measured for a unit and each of parts. Then, the used time period, the total copy number, the total rotation number stored in the EEPROM 42 for the replaced unit and used parts are erased. Specifically, as shown in FIG. 14, it is first checked if an erase signal for erasing a usage time period is included in step S72. If the checking result is positive (i.e., Yes, in step S72), a used time period for a unit is erased from the EEPROM 42 in step S72. A used time period of a replaced part is also erased from the EEPROM 42 in step S74. It is then checked if an erase signal for erasing a total copy number is included in step S75. If the checking result is positive (i.e., Yes, in step S75), a total copy number for a unit is erased from the EEPROM 42 in step S76. Then, a total copy number for a replaced part is also erased from the EEPROM 42 in step S77. It is then checked if an erase signal for erasing a total rotation number is included in step S78. If the checking result is positive (i.e., Yes, in step S78), a total rotation number for a replaced roller is erased from the EEPROM 42 in step S79, and the process is terminated n step S80.

In the above, a photoconductive member unit 3 and a toner cartridge 30 are exemplified as an image formation unit detachable to an image forming apparatus. However, the image formation unit is not limited thereto and can include a modification, in which a photoconductive member unit mounting a photoconductive member, a charge roller, and a cleaning device, and a developing unit are employed separately detached to the image forming apparatus. In such a situation, anon-volatile memory device can be attached to the developing unit. Further, the EEPROM 42 is employed as a non-volatile memory in the above-mentioned example. However, it is not limited thereto and can include a ferroelectric substance memory element. Numerous additional modifications and variations of the present invention are possible in light of the above teachings. It is therefore to be understood that within the scope of the appended claims, the present invention may be practiced otherwise than as specifically described herein.

What is claimed is:

1. An apparatus, comprising:

an image formation unit including at least one replacement member and a nonvolatile memory, said nonvolatile memory storing recycle information related to the at least one replacement member, said recycle information being referred to when the image formation unit is recycled;

a first life detecting device configured to detect an end of life of the image formation unit;

a second life detecting device configured to detect an end of life of the at least one replacement member;

a usage inhibition code writing device configured to write a usage inhibition code in the nonvolatile memory when the first life detecting device detects the end of life of the image formation unit or when the second life detecting device detects the end of life of the at least one replacement member, said usage inhibition code notifying inhibition of reuse of the image formation unit when the first life detecting device detects an end of life of the image formation unit, and said usage inhibition code notifying inhibition of reuse of the image formation unit when the second life detecting device detects an end of life of the at least one replacement member; and a replacement member code writing device configured to write a code identifying the at least one replacement member in the nonvolatile memory when the second life detecting device detects the end of life of the at least one replacement member, wherein said nonvolatile memory stores a usable date of the at least one replacement member, and wherein said second life detecting device detects the end of life of the at least one replacement member by comparing current date information with the usable date.

2. The apparatus according to claim 1, further comprising: a unit used time calculation device configured to calculate a used time period in which the image formation unit is used, wherein said nonvolatile memory stores a usage guaranteed time for the image formation unit, and wherein said first life detecting device detects the end of life of the image formation unit by comparing the used time period with the usage guaranteed time.

3. The apparatus according to claim 1, further comprising: a replacement member used time calculation device configured to calculate a replacement member used time period in which the at least one replacement member is used, wherein said nonvolatile memory stores a usage guaranteed time for the at least one replacement member, and wherein said second life detecting device detects the end of life of the at least one replacement member by comparing the replacement member used time period with the usage guaranteed time.

4. The apparatus according to claim 1, wherein said nonvolatile memory stores a usable date of the image formation unit, and wherein said first life detecting device detects the end of life of the image formation unit by comparing current date information with the usable date.

5. The apparatus according to claim 1, wherein the current date information is transmitted from a control section of the apparatus.

6. The apparatus according to claim 1, wherein said nonvolatile memory stores a limiting number of image formations for the image formation unit, and wherein said first life detecting device detects the end of life of the image formation unit by comparing a total number of image formations executed by the image formation unit with the usage limiting number.

7. The apparatus according to claim 1, wherein said nonvolatile memory stores a limiting number of image formations for the at least one replacement member, and wherein said second life detecting device detects the end of life of the at least one replacement member by comparing a total number of images formed by the image formation unit with the limiting number of image formations.

8. The apparatus according to claim 1, wherein said at least one replacement member includes at least one rotation member and said nonvolatile memory stores a limiting number of rotations for the at least one replacement member, and wherein said second life detecting device detects the end of life of the at least one rotation member by comparing a total number of rotations of the at least one rotation member with the limiting number of rotations.

9. The apparatus according to claim 8, wherein said at least one rotation member includes a photoconductive drum, a developing roller, a charging roller, a transfer roller, and a fixing roller.

10. The apparatus according to claim 1, wherein said image formation unit includes one of a process cartridge, a developing cartridge, and a toner cartridge.

11. The apparatus according to claim 10, wherein said first life detecting device detects the end of life of the toner cartridge when toner end is detected, wherein said nonvolatile memory stores data indicative of no toner when the toner end is detected.

12. The apparatus according to claim 10, wherein said process cartridge integrally mounts at least one of an image bearer, a charging device, a developing device, a transferring device, and a cleaning device.

13. The apparatus according to claim 12, wherein said replacement member includes at least one of the image bearer and the cleaning device.

14. The apparatus according to claim 1, wherein said nonvolatile memory includes an EEPROM.

15. The apparatus according to claim 1, wherein the recycle information indicates a number of times the at least one replacement member has been recycled.

16. The apparatus according to claim 1, wherein the first life detecting device and the second life detecting device comprise a common CPU.

* * * * *